US009079677B2

(12) United States Patent
Alaterre

(10) Patent No.: US 9,079,677 B2
(45) Date of Patent: Jul. 14, 2015

(54) VACUUM PACKAGING ASSEMBLY AND METHOD

(75) Inventor: Michel Alaterre, Breteuil sur Iton (FR)

(73) Assignee: APTAR FRANCE SAS, Le Neubourg (FR)

( * ) Notice: Subject to any disclaimer, the term of this patent is extended or adjusted under 35 U.S.C. 154(b) by 757 days.

(21) Appl. No.: 13/389,706

(22) PCT Filed: Aug. 23, 2010

(86) PCT No.: PCT/FR2010/051757

§ 371 (c)(1),
(2), (4) Date: Feb. 9, 2012

(87) PCT Pub. No.: WO2011/023895

PCT Pub. Date: Mar. 3, 2011

(65) Prior Publication Data

US 2012/0137632 A1 Jun. 7, 2012

(30) Foreign Application Priority Data

Aug. 25, 2009 (FR) ..... 09 55784

(51) Int. Cl.
*B65B 31/02* (2006.01)
*B65B 7/28* (2006.01)

(52) U.S. Cl.
CPC ..... *B65B 7/2821* (2013.01); *B65B 7/2842* (2013.01); *B65B 31/025* (2013.01)

(58) Field of Classification Search
CPC ..... B65B 7/2842; B65B 7/2821; B65B 7/28; B65B 31/02; B65B 31/028; B65B 31/027; B65B 31/025
USPC ..... 53/405, 408, 432, 84–86, 89, 97, 53/101–104, 106–108, 510; 417/490, 491, 417/493, 521, 534
See application file for complete search history.

(56) References Cited

U.S. PATENT DOCUMENTS 1,081,466 A * 12/1913 Prosser ..... 53/104
1,556,981 A * 10/1925 Voight ..... 53/86

(Continued)

FOREIGN PATENT DOCUMENTS

DE 1432143 A1 * 3/1969 ..... B65B 31/027
DE 2317517 A1 * 10/1974 ..... B65B 31/025
GB 344408 A 3/1931
GB 2 322 851 A 9/1998
WO WO 01/42086 A1 6/2001

OTHER PUBLICATIONS

International Search Report of PCT/FR2010/051757 dated Dec. 23, 2010, 2 pages.

(Continued)

*Primary Examiner* — Stephen F Gerrity
(74) *Attorney, Agent, or Firm* — Sughrue Mion, PLLC

(57) ABSTRACT

A conditioning assembly for conditioning an article (D), such as a fluid dispenser, under vacuum, the assembly including an airtight enclosure (E) for receiving an article (D) for conditioning under a vacuum;

Figure 1:
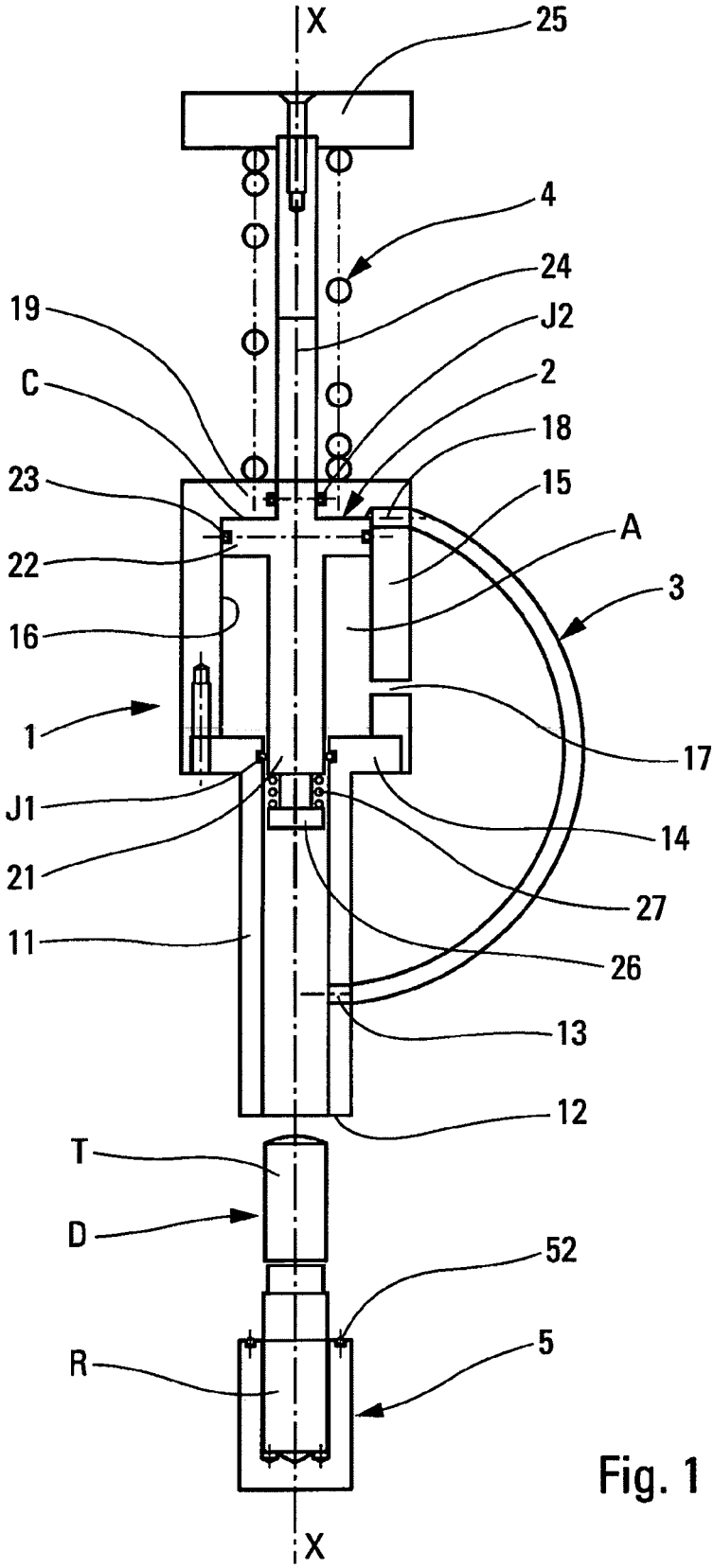

the assembly being characterized in that the enclosure (E) includes a conditioning element (21) that is movable inside the enclosure, the enclosure (E) being connected to a suction chamber (C) that includes a piston (22) that is capable of causing the volume of the chamber (C) to vary, the conditioning element (21) and the piston (22) being constrained to move together in a manner such that a movement of the piston (22) in the direction for increasing the volume of the chamber (C) causes suction to be generated in the enclosure (E).

14 Claims, 3 Drawing Sheets

(56) References Cited

U.S. PATENT DOCUMENTS

| | | | | | |
|---|---|---|---|---|---|
| 2,423,358 | A | * | 7/1947 | Wheaton et al. | 53/432 |
| 2,792,678 | A | * | 5/1957 | Baldwin, Jr. et al. | 53/101 |
| 3,018,594 | A | * | 1/1962 | Phillips et al. | 53/72 |
| 4,278,114 | A | * | 7/1981 | Ruberg | 53/103 |
| 5,217,050 | A | * | 6/1993 | Varlet | 53/510 |
| 5,228,269 | A | * | 7/1993 | Sanfilippo et al. | 53/432 |
| 5,237,797 | A | * | 8/1993 | Varlet | 53/434 |
| 2007/0175538 | A1 | * | 8/2007 | Rothbauer et al. | 141/59 |

OTHER PUBLICATIONS

International Preliminary Report on Patentability for PCT/FR2010/051757, dated Feb. 28, 2012, 5 pages.

International Preliminary Report on Patentability for PCT/FR2010/051757, dated Mar. 6, 2012, 4 pages.

* cited by examiner

VACUUM PACKAGING ASSEMBLY AND METHOD

CROSS REFERENCE TO RELATED APPLICATIONS

This application is a National Stage of International Application No. PCT/FR2010/051757 filed Aug. 23, 2010, claiming priority based on French Patent Application No. 0955784 filed Aug. 25, 2009, the contents of all of which are incorporated herein by reference in their entirety.

The present invention relates to a conditioning assembly and method for vacuum conditioning an article, such as a fluid dispenser. The conditioning assembly includes an airtight enclosure in which the article is placed for conditioning under a vacuum. The present invention finds an advantageous application in the field of cosmetics, or even in the field of pharmacy or of foodstuffs.

It is already known in the field of cosmetics to condition cosmetics, such as creams, gels, lotions, etc. under a vacuum in fluid dispensers that comprise reservoirs on which there are mounted dispenser pumps or valves on which the user acts by means of one or more fingers so as to dispense fluid, optionally in metered form. In particular, it is known to fill and/or to seal the fluid dispenser in an enclosure in which there exists an air vacuum that is generated by a vacuum pump. Filling under a vacuum ensures that no air bubbles are introduced into the fluid mass. Sealing under a vacuum consists in mounting the pump or the valve in sealed manner on the reservoir as filled in an enclosure in which there exists an air vacuum. This guarantees that there is no, or only very little, air inside the reservoir in contact with the fluid. The purpose is to improve the preservation of fluids that are sensitive to spoiling on contact with air. The greater the sensitivity of the fluid to air, the higher the vacuum inside the enclosure. Consequently, with certain particular fluids, it is essential to condition (package and/or seal) them in an enclosure in which there exists a high air vacuum. Conversely, certain fluids are less sensitive, but it is nevertheless preferable to condition them in an atmosphere that is poor in air. Still other fluids are not sensitive to spoiling on contact with the air, but vacuum conditioning cannot harm them. Thus, the vacuum levels used may vary (high vacuum, partial vacuum, low vacuum) as a function of the fluid to be conditioned.

The drawback with conventional vacuum enclosures resides in the fact that it is necessary to use a vacuum pump, which is a costly machine that requires regular maintenance. Until the present, in the field of cosmetics, it has not been possible to do without a vacuum pump in order to generate a vacuum inside an enclosure in which fluid dispensers are conditioned.

An object of the present invention is to remedy the abovementioned drawback of the prior art by proposing a conditioning assembly that is capable of generating a vacuum or suction inside an enclosure for conditioning fluid dispensers without using a vacuum pump. Naturally, the present invention is not limited to conditioning fluid dispensers, but extends to any article that needs to be conditioned under a vacuum.

To do this, the present invention proposes a conditioning assembly for conditioning an article, such as a fluid dispenser, under vacuum (low, partial, or even high vacuum), the assembly including an airtight enclosure for receiving an article for conditioning under a vacuum in said enclosure, the assembly being characterized in that the enclosure includes a conditioning element that is movable inside the enclosure, the enclosure being connected to a suction chamber that includes a piston that is capable of causing the volume of the chamber to vary, the conditioning element and the piston being constrained to move together in a manner such that a movement of the piston in the direction for increasing the volume of the chamber causes suction to be generated in the enclosure. Advantageously, the conditioning element constitutes a press element that is adapted to exert axial pressure on the article, once the enclosure is under suction. Thus, within a single conditioning operation, a vacuum is achieved inside the enclosure, and the fluid dispenser is mounted (fastened/sealed), and this without the use of a vacuum pump or additional energy. The force that is used to move the conditioning element inside the enclosure is also used to move the piston inside the suction chamber that generates suction inside the enclosure. Once the suction has been generated, the conditioning element reaches the end of its stroke and performs the operation of conditioning the dispenser inside the enclosure in which there exists a low, partial, or high vacuum. The term "partial vacuum" should be understood to mean a pressure that is lower than the atmospheric pressure that may reach low pressure values, but without being considered as a high vacuum. With the present invention, it is possible to reach an average vacuum of about 0.4 atmospheres (atm), for example.

According to an advantageous characteristic of the invention, the piston and the conditioning element are both urged by resilient return means into a rest position, in which the suction chamber presents a minimum volume, advantageously zero, and the enclosure presents a maximum volume. Advantageously, the conditioning element is capable of generating a variation in the volume of the enclosure, with the increase in the volume of the chamber being greater than the decrease in the volume of the enclosure, in such a manner as to generate suction, both in the chamber and in the enclosure. Thus, the conditioning element decreases the volume of the enclosure, and simultaneously, the piston increases the volume of the suction chamber more rapidly, thereby generating suction that sucks air out from the enclosure. A partial vacuum, that may even be relatively high, can thus be achieved. By providing a suction-chamber volume that is considerably greater than the volume of the enclosure, a high vacuum may be achieved. By way of example, provision may be made for the chamber to define a slide cylinder for the piston, the cylinder presenting a diameter that is greater than the diameter of the enclosure at the conditioning element.

In a practical embodiment of the invention, the enclosure may comprise a bottom portion in which the article is placed, and a top portion that is capable of coming into sealing contact with the bottom portion so as to form the enclosure, the bottom and top portions being movable relative to each other along an axis X, the conditioning element being situated in the top portion in such a manner as to move along the axis, the piston being slidably mounted in the suction chamber to slide along the axis X. Advantageously, the suction chamber is defined by a sleeve, and the piston, the sleeve, and the top portion of the enclosure co-operate with one another to form a base body. Thus, all of the relative movements of the conditioning assembly take place along a single axis. It is the relative movement of the various elements of the conditioning assembly that makes it possible initially to form the enclosure, then to generate a vacuum or suction, then finally to mount the fluid dispenser inside the enclosure in which the vacuum exists.

According to another practical characteristic, the piston and the conditioning element are connected together as a single piece, and they include a common actuator member for moving them together along the axis, against the resilient return means. Advantageously, the conditioning assembly includes a movable unit that is movable downwards and upwards in the base body, against resilient return means, the movable unit forming the conditioning element, the piston, and the common actuator member. Thus, the conditioning assembly is essentially constituted by two distinct parts, namely: the base body that is movable relative to the bottom portion that receives the article; and the movable unit that is movable relative to both the base body and the bottom portion. The resilient return means make it possible to return the movable unit into its rest position.

In another advantageous aspect of the invention, the enclosure is connected to the suction chamber via a duct that is capable of selectively connecting the suction chamber to the enclosure. Thus, by way of example, the conditioning assembly may be used merely as an assembly press, without conditioning that assembly under a vacuum, or else it may be used as a press that simultaneously generates a vacuum or suction in an airtight enclosure.

According to a very advantageous characteristic, the chamber defines a slide cylinder for the piston, the cylinder including a vent hole, the piston reaching the vent hole at the end of its stroke so as to return the chamber and the enclosure to atmospheric pressure.

According to another practical characteristic, the enclosure or the element may include a differential-stroke device enabling the piston to continue its stroke as far as the vent hole, while the head is already in its final mounted position on the reservoir.

In a variant embodiment, the piston moves over a determined suction stroke, and the conditioning element moves over a determined conditioning stroke, the piston and the conditioning element being secured to each other merely over a limited stroke that corresponds to the conditioning stroke. In this configuration, the piston is not connected to the conditioning element, but merely comes into contact therewith at the end of the piston stroke so as to drive it over its conditioning stroke. It can thus be said that the piston and the conditioning element are not constrained to move together, but move together only temporarily.

The invention also defines a method of vacuum conditioning an article using a conditioning assembly as described above.

The spirit of the invention is to make use of the movement of an element of a conditioning assembly without any additional energy or operation to generate a vacuum in an airtight enclosure in which the movable element operates. The element may perform a conventional assembly-press function, or even any other function necessary for conditioning an appropriate article. By way of example, the movable element may serve to screw-fasten, crimp, heat-seal, pinch, deform, etc.

The invention is described more fully below with reference to the accompanying drawings, which show an embodiment and an operating method for a conditioning assembly of the invention by way of non-limiting example.

Figure 2D:
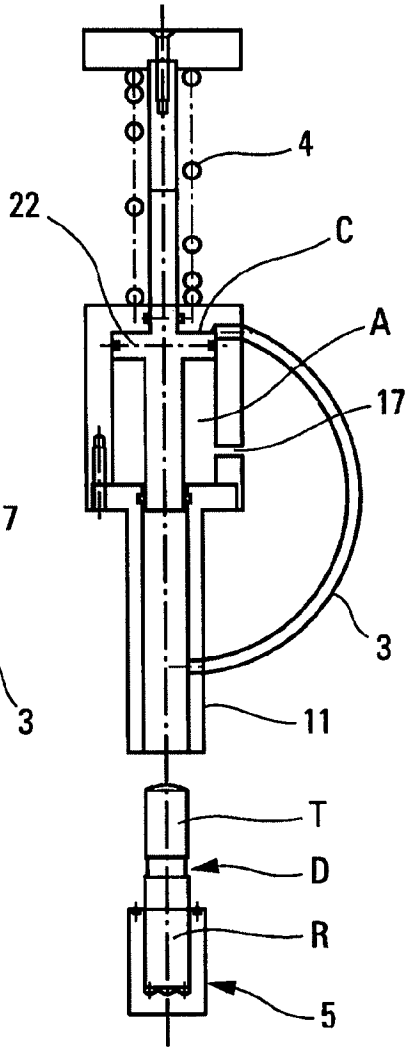
Figure 2C:
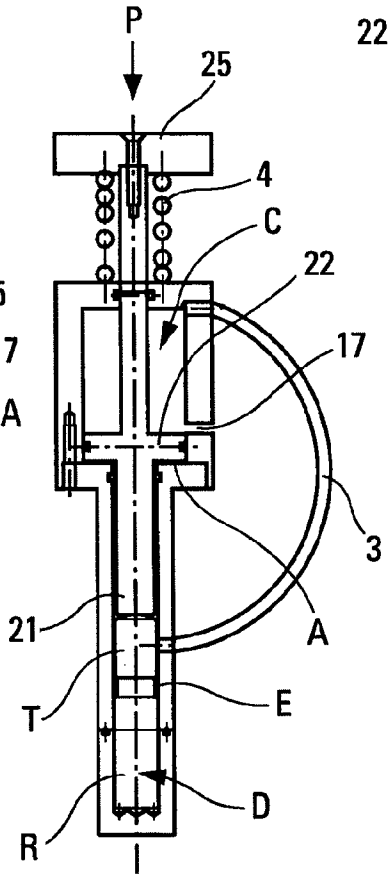
Figure 2B:
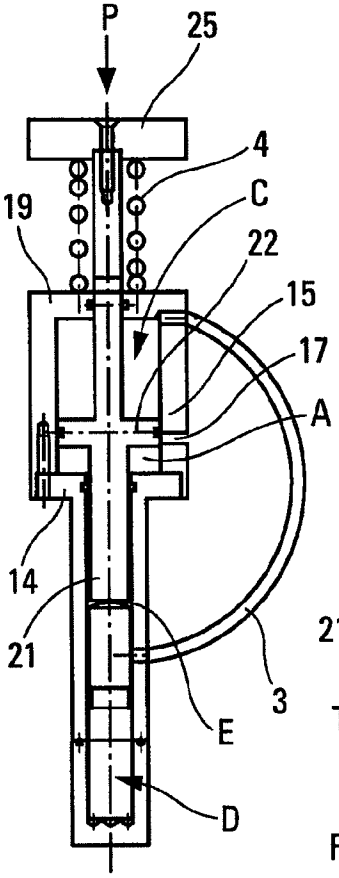
Figure 2A:
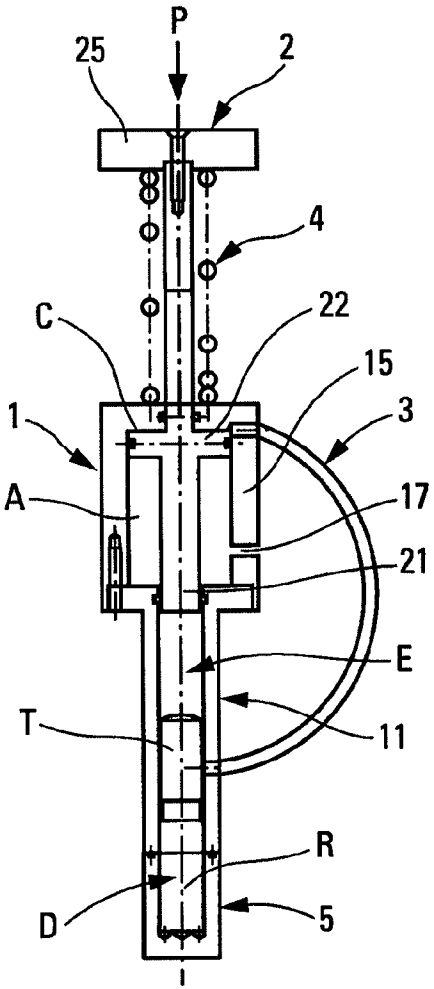
Figure 3:
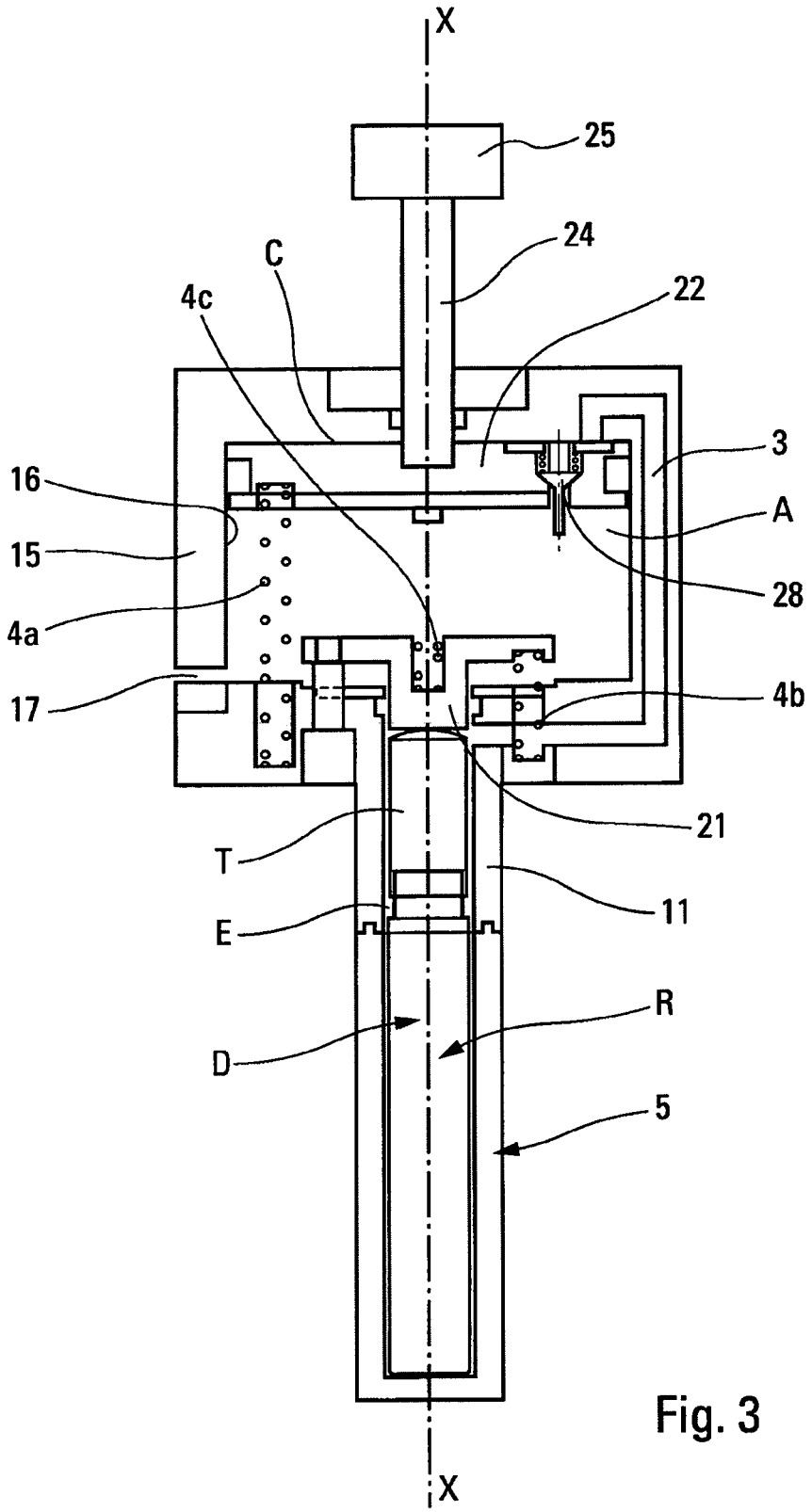

In the figures:

FIG. 1 is a section view of a conditioning assembly made in accordance with the present invention;

FIGS. 2*a* to 2*d* show the FIG. 1 conditioning assembly during various stages of its operating cycle; and FIG. 3 is a diagrammatic section view of a variant embodiment of a conditioning assembly of the invention.

Reference is made firstly to FIG. 1 in order to explain in detail the structure and the operation of a conditioning assembly of the invention. The conditioning assembly is more particularly adapted to conditioning an article D that is a fluid dispenser, such as those found in the fields of cosmetics and pharmacy. Conventionally, fluid dispensers of such fields comprise a reservoir R for containing the fluid, and a dispenser head T that is mounted in sealed manner on the reservoir. The dispenser head T conventionally includes a dispenser member, such as a pump or a valve, that is mounted on the reservoir directly or by means of a fastener ring. The dispenser member is under a pusher that is axially movable by means of one or more fingers so as to actuate the dispenser member and thus dispense the fluid, optionally in metered form. The dispenser head T may also be fitted with a protective cap that comes to cover the pusher. This design is entirely conventional for a fluid dispenser adapted to dispensing a cosmetic or pharmaceutical. However, the present invention is not limited to conditioning only dispensers of this type, but applies more generally to any article for which it is necessary to use conditioning under an at least partial vacuum.

The conditioning assembly of the invention essentially comprises a bottom enclosure portion 5, a base body 1, and a movable unit 2. A return spring 4 that acts as return means is added to those elements, together with a duct 3 that is mounted on the base body 1. The bottom portion 5, the base body 1, and the movable unit 2 are preferably made out of metal, advantageously by using machining, assembly, and/or molding methods.

The bottom enclosure portion 5 is in the form of a cup comprising a bottom wall, a side wall, and a free top annular edge that is provided with an O-ring 52. The bottom portion 5 is for receiving the article D that requires the conditioning operation. In the present invention, it is considered that the article, which is a fluid dispenser, requires conditioning for the purpose of mounting the dispenser head T in sealed manner on the reservoir R, with this being done under vacuum. It can thus be seen in FIG. 1 that the reservoir R is received inside the cup that is formed by the bottom portion 5. The reservoir R projects out from the bottom portion 5, as does the dispenser head T, which is merely placed on the reservoir, without creating sealing contact therewith.

The base body 1 includes a top enclosure portion 11 that defines a free bottom annular edge 12 for coming into sealing contact with the O-ring 52 of the bottom portion 5. The top portion 11 is movable towards the bottom portion 5, or vice versa. Once in sealing contact, the two portions 5 and 11 co-operate with each other to form an airtight enclosure that is isolated from the outside. In this embodiment, the top portion 11 is in the form of a hollow elongate tube that defines a housing having an inside diameter that is sufficient to receive the article D to be conditioned. In this configuration, the dispenser head T may be engaged easily inside the tube that is formed by the top portion 11. The top portion 11 is provided with a side hole 13 to which a duct 3 is connected. At the end remote from the bottom edge 12, the top portion 11 defines an annular collar 14 the projects outwards. The housing formed inside the top portion 11 extends therethrough from its free bottom edge 12 up to the collar 14. At the collar 14 there is provided an O-ring J1 having a function that is explained below. At its outer periphery, the collar 14 is connected to a sleeve 15 that internally defines a slide cylinder 16 having a diameter that is greater than the diameter of the housing of the bottom portion 11. The sleeve 15 is formed with a vent hole 17 and with a hole 18 in which the duct 3 is connected. Thus, the top portion 11 is connected to the sleeve 15 by means of the duct 3. Advantageously, the duct is removable or closable so as to be able selectively to interrupt or to establish communication between the top portion 11 and the sleeve 15. The sleeve 15 also defines a shoulder 19 that extends inwards. The shoulder 19 defines a through opening that is provided with an O-ring J2. As a result of the presence of the collar 14 and of the shoulder 19, a volume of constant size is defined inside the sleeve 15.

The movable unit 2 includes a conditioning element 21 that is a press element in the embodiment in the figures. It is also possible to provide a screw-fastening, crimping, heat-sealing, folding, etc. element, without going beyond the ambit of the invention. The conditioning element 21 is movable inside the top portion 11, with this being done in a manner that is sealed by the O-ring J1. Consequently, the conditioning element 21 acts, in sealed manner, to separate the top portion 11 from the volume formed inside the sleeve 15. At its top end, the movable element 21 is connected to a piston 22 that slides in a manner that is sealed by means of the presence of an O-ring 23 inside the cylinder 16 formed by the sleeve 15. The piston 22 is extended upwards by a thrust transmission rod 24 that is surmounted by a bearing plate 25 on which axial pressure may be exerted. The rod 24 slides in sealed manner inside the O-ring J2 that is provided in the shoulder 19. The return spring 4 is engaged around the rod 24 and bears firstly under the plate 25, and secondly on the shoulder 19. Consequently, the return spring 4 urges the movable unit 2 into a rest position relative to the base body 1, which position is the position shown in FIG. 1. In this position, the rod 24 extends as far as possible out from the sleeve 15, the piston 22 comes into abutment against the shoulder 19, and the conditioning element 21 is retracted as far as possible into the sleeve 15. It can thus be observed that an annular space A is formed inside the sleeve 15 around the conditioning element 21. The annular space A is closed at its top end by the piston 22 and at its bottom end by the collar 14. Nevertheless, the space A can communicate freely with the outside through the vent hole 17 that is formed in the sleeve 15. Consequently, the annular space A is always at atmospheric pressure. It should not be forgotten that the annular space A does not communicate with the top portion 11, as a result of the presence of the O-ring J1 that is in sealed sliding contact around the conditioning element 21.

In the rest position as shown in FIG. 1, the piston 22 is in abutment against the shoulder 19. However, it can easily be understood that by pressing on the plate 25, the piston 22 is moved downwards inside the sleeve 15, sliding in sealed manner inside the cylinder 16. A volume is thus created between the O-ring J2 and the piston O-ring 23: the volume forms a suction chamber that communicates only with the top portion 11 via the hole 18, the duct 3, and the hole 13. In other words, increasing the volume of the suction chamber C causes the air contained inside the top enclosure portion 11 to be sucked out. And when the top portion 11 is in sealing contact with the bottom portion 5, thereby forming the airtight enclosure, the increase in the volume of the suction chamber C causes a vacuum or suction to be created inside the enclosure. The enclosure is neither shown nor referenced in FIG. 1, given that it is not formed.

Reference is made below to FIGS. 2*a*, 2*b*, 2*c*, and 2*d* in order to describe in detail a complete operating cycle of the FIG. 1 conditioning assembly. FIG. 2*a* merely results in putting the bottom edge 12 of the top portion 11 into contact with the O-ring 52 of the bottom portion 5. The movable unit 2 remains stationary relative to the base body 1. In other words, the conditioning element 21 remains stationary relative to the top portion 11. The relative movement of the bottom and top portions 5, 11 is merely to form the enclosure E in which a partial vacuum is to be generated. The article D, namely the fluid dispenser, is arranged inside the enclosure E in its non-assembled state, such that the inside of the reservoir R communicates directly with the enclosure E. From the position shown in FIG. 2*a*, axial pressure starts to be exerted on the plate 25 so as to move the movable unit 2 relative to the base body 1. This has several effects simultaneously. The plate 25 moves closer to the sleeve 15, thereby compressing the return spring 4. But more particularly, the piston 22 separates from the shoulder 19, creating the suction chamber C and increasing its volume. In contrast, the volume of the annular space A decreases, with the air being expelled therefrom through the vent hole 17. Finally, the conditioning element 21 moves into the enclosure E, decreasing its working volume. The element 21 may be considered as constituting a kind of piston that slides inside the enclosure E in sealed sliding contact with the O-ring J1. As a result, the movement of the element 21 causes the volume of the enclosure E to vary. The increase in the volume of the suction chamber C causes suction to be created inside the enclosure E via the duct 3. The maximum volume of the suction chamber C relative to the volume of the enclosure E is determined as a function of the desired level of vacuum. By selecting a suction chamber of volume that is considerably greater than the volume of the enclosure E, a high vacuum is generated. Returning to FIG. 2*b*, it can be seen that the piston 22 has not yet come into abutment against the collar 14, but it is already in contact with the head T of the dispenser D. It is thus possible to continue to push on the plate 25 so as to push the head T hard onto the reservoir R so as to assemble the dispenser D in sealed manner. Thus, the dispenser is assembled while the enclosure E is being subjected to a maximum vacuum. The suction chamber C thus reaches its maximum volume, and the annular space A is reduced to a volume of zero, or almost zero. The vacuum reaches a maximum value inside the chamber C, but also inside the enclosure E connected to the chamber via the duct 3. By continuing to press on the plate 25, the movable unit 2 reaches the end of its stroke inside the base body 1, against the return spring 4, as shown in FIG. 2*c*. It should be observed that the piston 22 passes below the vent hole 17, which means that the chamber C then communicates directly with the outside, and is thus returned to atmospheric pressure. The same applies for the enclosure E, which is still connected to the space A via the duct 3. This means that the return to atmospheric pressure occurs automatically at any end-of-stroke, without the need to control any valve. Naturally, it is essential that the return to atmospheric pressure occurs just after the head T is finally mounted on the reservoir R.

In order to enable the piston to continue its stroke as far as the vent hole, while guaranteeing conditioning under a vacuum, it is necessary for the sealing between the head and the reservoir to be achieved prior to the piston reaching the vent hole. By way of example, provision may be made for the sealing between the head and the reservoir to be established prior to reaching the final mounted position. In this configuration, the piston arrives at the vent hole at the time the head reaches its final mounted position on the reservoir R. In a preferred variant, the element 21 may be provided with a differential-stroke device 26 that is formed at the free end of the element 21 and that comes into contact with the head T. The device enables the piston 22 to continue its stroke as far as the vent hole 17, while the head T is already in its final mounted position on the reservoir R. The differential-stroke device 26 comprises resilient means 27, e.g. in the form of a spring, having stiffness that is greater than the bearing force required to mount the head T on the reservoir. While the head is being mounted on the reservoir, the resilient means do not operate, and they are stressed only during the final stroke of the piston in order to reach the vent hole. It is also possible to provide a similar device in the bottom portion 5 of the enclosure. Thus, once the suction chamber C and the enclosure E return to atmospheric pressure, it then suffices to relax the pressure on the plate 25, and to open the enclosure so as to remove the dispenser in it final assembled state.

It should be observed that the conditioning assembly of the invention defines a single axis X along which all of the component elements of the conditioning assembly move. Consequently, merely by pressing on the plate 25, it is possible to form the enclosure E, to move the element 21, and to create and increase the volume of the suction chamber C. In other words, the volume of the suction chamber C is created and increased without any additional manipulation or operation other than that necessary to move the conditioning element 21. Consequently, the addition of the suction chamber C does not complicate the operation of a conventional assembly press used to mount dispenser heads on fluid reservoirs. This results from the piston 22 and the element 21 being constrained to move together. The operating rate of the conditioning assembly is not even affected by the presence of the suction chamber C, given that the suction is generated instantaneously and is necessarily synchronized with the element 21, since said element 21 is made integrally with the piston 22.

Reference is made below to FIG. 3 that shows a variant embodiment of a conditioning assembly of the invention. The overall structure of the variant embodiment is very comparable or similar to the structure of the FIG. 1 conditioning assembly. There can be seen an enclosure E comprising a bottom portion 5 in which the dispenser D is placed, and a top portion 11 that is capable of coming into sealing contact with the bottom portion 5, which portions thereby co-operate with each other to form the enclosure E. The enclosure is also connected to a suction chamber C having a volume this is zero in FIG. 3. The suction chamber C includes a piston 22 that is capable of causing the volume of the chamber to vary. The piston 22 is secured to a common actuator member 24, 25 on which a force may be exerted so as to move the piston inside the chamber. Below the piston 22 there is formed a space A that is connected to the outside via a vent hole 17. The space A is thus always at atmospheric pressure. The conditioning assembly also includes a conditioning element 21 that finishes off the enclosure E, and that is for acting on the dispenser head T of the dispenser D. Specifically, the purpose of the conditioning element is to mount the dispenser head T in permanent and sealed manner on the reservoir R of the dispenser D. The conditioning element 21 is urged into a rest position by a spring 4*b*. The conditioning element 21 further includes a compensation spring 4*c* having a function that is described below. In symmetrical manner, the piston 22 is urged into its rest position by a spring 4*a*. In the rest position, the volume of the suction chamber C is zero or at its minimum, while the volume of the space A is at its maximum. The volume of the enclosure E is also at its maximum in the rest position of the conditioning element that is urged by the spring 4*b*.

In contrast to the embodiment in FIG. 1, the piston 22 is not secured to the conditioning element 21. It should be observed that the two parts are separated from each other by the space A. Thus, when pressure is exerted on the actuator member 24-25 along the axis X, the piston 22 moves downwards so as to increase the volume of the suction chamber C and to decrease the volume of the space A. In this way, suction is created inside the chamber C, which suction is communicated to the enclosure E via an internal duct 3. Thus, the enclosure E is put under suction, and said suction increases as the piston 22 moves towards the conditioning element 21. When the piston 22 comes into contact with the conditioning element 21, the suction inside the compression chamber C and the enclosure E is at its maximum. By continuing to move the piston 22, the conditioning element 21 is pushed downwards, thereby causing pressure to be exerted on the dispenser head T and causing it to be mounted on the reservoir R. At the end of stroke, the suction chamber C is returned to atmospheric pressure by opening a valve 28 that is provided on the piston 22, for selectively putting the suction chamber C into communication with the space A that is connected to the outside via the vent 17.

In other words, the piston 22 moves over a suction stroke, and the conditioning element 22 moves over a conditioning stroke that is not the same as the stroke of the piston 22, given that the two elements are not constantly secured to each other. However, when the piston 22 comes into contact with the conditioning element 21, their strokes are the same, given that the two elements and then constrained to move together.

In order to avoid the conditioning element 21 exerting excessive force on the dispenser head T, the pressure exerted by the piston 22 is communicated to the conditioning element 21 through the compensation spring 4*c*. This characteristic is optional.

Having the piston 22 separate from the conditioning element 21 makes it possible to decrease the stroke of the conditioning element considerably, thereby enabling a high level of suction to be generated. This makes it possible to reduce the height of the enclosure E considerably, in particular in its top portion 11.

Without going beyond the ambit of the invention, it is possible to imagine still other embodiments of a conditioning assembly of the invention, in which a piston is moved so as to create suction in a chamber that communicates with the enclosure in which an article such as a fluid dispenser is conditioned. The piston is secured to the conditioning element over at least a fraction of its stroke.

By means of the invention, it is possible to replace a conventional conditioning station, such as a station for pressing, screw-fastening, crimping, heat-sealing, and more generally conditioning, by the conditioning assembly of the invention, without any need to modify the surroundings of the station and without any need to add additional accessories, such as a vacuum pump, for example.

The invention claimed is:

1. A conditioning assembly for conditioning an article under vacuum, the assembly including an airtight enclosure for receiving an article for conditioning under a vacuum;

the assembly being characterized in that the enclosure includes a conditioning element that is movable inside the enclosure, the enclosure being connected to a suction chamber that includes a piston that is capable of causing the volume of the chamber to vary, the conditioning element and the piston being constrained to move together in a manner such that a movement of the piston in the direction for increasing the volume of the chamber causes suction to be generated in the enclosure.

2. A conditioning assembly according to claim 1, wherein the piston and the conditioning element are both urged by resilient return means into a rest position, in which the suction chamber presents a minimum volume, advantageously zero, and the enclosure presents a maximum volume.

3. A conditioning assembly according to claim 1, wherein the conditioning element is capable of generating a variation in the volume of the enclosure, the volume of the suction chamber sized relative to the volume of the enclosure such that movement of the piston in the direction for increasing the volume of the chamber results in the increase in the volume of the chamber by an amount that is greater than the decrease in the volume of the enclosure, thereby generating suction in both the chamber and in the enclosure.

4. A conditioning assembly according to claim 1, wherein the enclosure comprises a bottom portion in which the article is placed, and a top portion that is capable of coming into sealing contact with the bottom portion so as to form the enclosure, the bottom and top portions being movable relative to each other along an axis, the conditioning element being situated in the top portion in such a manner as to move along the axis, the piston being slidably mounted in the suction chamber to slide along the axis.

5. A conditioning assembly according to claim 4, wherein the suction chamber is defined by a sleeve, and the piston, the sleeve, and the top portion of the enclosure co-operate with one another to form a base body.

6. A conditioning assembly according to claim 1, wherein the piston and the conditioning element are connected together as a single piece, and they include a common actuator member for moving them together along an axis, against a resilient return means.

7. A conditioning assembly according to claim 6, including a movable unit that is movable downwards and upwards in a base body, against the resilient return means, the movable unit forming the conditioning element, the piston, and the common actuator member.

8. A conditioning assembly according to claim 1, wherein the piston moves over a determined suction stroke, and the conditioning element moves over a determined conditioning stroke, the piston and the conditioning element being secured to each other merely over a limited stroke that corresponds to the conditioning stroke.

9. A conditioning assembly according to claim 1, wherein the conditioning element constitutes a press element that is adapted to exert axial pressure on the article, once the enclosure is under suction.

10. A conditioning assembly according to claim 1, wherein the chamber defines a slide cylinder for the piston, the cylinder presenting a diameter that is greater than the diameter of the enclosure at the conditioning element.

11. A conditioning assembly according to claim 1, wherein the chamber defines a slide cylinder for the piston, the cylinder including a vent hole, the piston reaching the vent hole at the end of its stroke so as to return the chamber and the enclosure to atmospheric pressure.

12. A conditioning assembly according to claim 11, wherein the article comprises a head to be mounted on a reservoir, a differential-stroke device enabling the piston to continue its stroke as far as the vent hole, while the head is already in its final mounted position on the reservoir.

13. A conditioning assembly according to claim 1, wherein the enclosure is connected to the suction chamber via a duct.

14. The conditioning assembly according to claim 1, wherein the article is a fluid dispenser.

* * * * *